US006708013B2

(12) United States Patent
Nomura

(10) Patent No.: US 6,708,013 B2
(45) Date of Patent: Mar. 16, 2004

(54) COLOR IMAGE FORMING APPARATUS

(75) Inventor: Yujiro Nomura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/170,215

(22) Filed: Jun. 13, 2002

(65) Prior Publication Data

US 2003/0138268 A1 Jul. 24, 2003

(30) Foreign Application Priority Data

Jun. 14, 2001 (JP) ..... P2001-179790
Jun. 14, 2001 (JP) ..... P2001-179791
Jun. 14, 2001 (JP) ..... P2001-179792

(51) Int. Cl.[7] ..... G03G 15/01; G03G 15/14
(52) U.S. Cl. ..... 399/167; 399/75; 399/299
(58) Field of Search ..... 399/167, 298, 399/299, 302, 75, 110, 112

(56) References Cited

U.S. PATENT DOCUMENTS 6,142,690 A * 11/2000 Yoshimura et al. ..... 399/299 X
6,381,428 B1 * 4/2002 Yamamoto et al. ..... 399/110 X
2002/0127030 A1 * 9/2002 Yoda et al. ..... 399/167
2002/0141782 A1 * 10/2002 Yoda et al. ..... 399/167

FOREIGN PATENT DOCUMENTS

| | | | |
|---|---|---|---|
| JP | 61-156159 | | 7/1986 |
| JP | 06-167858 | * | 6/1994 |
| JP | 8-194361 | | 7/1996 |
| JP | 11-052657 | * | 2/1999 |
| JP | 11-231754 | | 8/1999 |
| JP | 2000-35090 | | 2/2000 |
| JP | 2000-039753 | * | 2/2000 |
| JP | 2000-293003 | * | 10/2000 |

* cited by examiner

*Primary Examiner*—Sophia S. Chen
(74) *Attorney, Agent, or Firm*—Sughrue Mion, PLLC

(57) ABSTRACT

A plurality of monochrome toner image carriers are respectively opposing to a circulating belt member to transfer each monochrome toner image onto the belt member or a recording medium held on the belt member. Each of a plurality of driving gears rotates one of the monochrome toner image carriers. Each of a plurality of intermediate gears is disposed between adjacent driving gears for transmitting a driving force from a previous driving gear to a subsequent driving gear. A rotation center of each intermediate gear is placed at a position shifted from a line connecting rotation centers of the adjacent driving gears.

50 Claims, 12 Drawing Sheets

COLOR IMAGE FORMING APPARATUS

BACKGROUND OF THE INVENTION

The present invention relates to a color image forming apparatus. More specifically, the invention relates to a so-called tandem type color image forming apparatus provided with a plurality of monochromatic toner image carriers on an intermediate transfer belt or a recording medium delivery belt which is to be circulated, and serving to sequentially transfer toner images having different colors which are formed by a monochromatic toner image carrier to a recording medium delivered through the intermediate transfer belt or the recording medium delivery belt, thereby forming a color image. In particular, the invention relates to a driving system for rotating each monochromatic toner image carrier.

Japanese Patent Publication No. 61-156159A discloses a conventional tandem type color image forming apparatus.

As shown in FIG. 10A, the conventional color image forming apparatus comprises a recording medium delivery belt 1 to be circulated, three photosensitive members 2Y, 2M and 2C to be monochromatic toner image carriers (for three colors of yellow (Y), magenta (M) and cyan (C)) provided on the recording medium delivery belt 1, and a gear train 3 (see FIG. 10B) for rotating the monochromatic toner image carriers, and serves to sequentially transfer toner images carried by the three monochromatic toner image carriers 2Y, 2M and 2C to a recording medium P supplied through a paper feeding roller 4 and delivered through the recording medium delivery belt 1, thereby forming a color image on the recording medium P.

A driving gear 3*a* (Y, C, M) is provided on the end of each of the monochromatic toner image carriers 2Y, 2M and 2C.

Intermediate gears 3*b* and 3*b* are provided between the driving gears 3*a* (Y, C, M), and the driving gears 3*a* (Y, C, M) and the intermediate gears 3*b* and 3*b* are provided in a line to constitute a gear train 3.

A driving source gear 5*a* to be rotated by a motor 5 is engaged with the driving gear 3*a* (Y) positioned on the end of the gear train 3. Consequently, each of the monochromatic toner image carriers 2 (Y, M, C) is rotated through the gear train 3.

Thus, the driving gears 3*a* (Y, C, M) and the intermediate gears 3*b* and 3*b* are arranged in a line so that each of the monochromatic toner image carriers 2 (Y, C, M) can be rotated at a minimum gear number.

In the conventional apparatus, as shown in FIG. 10B, since the centers of the rotation of the driving gears 3*a* (Y, C, M) and the centers of the rotation of the intermediate gears 3*b* and 3*b* in the gear train 3 are arranged on a straight line SL, the following problem arises.

More specifically, the driving gear 3*a* and the intermediate gear 3*b* have manufacturing errors respectively and are swollen by a rise in a temperature in the apparatus. In some cases, therefore, the sizes of the driving gear 3*a* and the intermediate gear 3*b* are increased to be greater than desirable dimensions.

In such a situation, if the centers of the rotation of the driving gears 3*a* (Y, C, M) and the centers of the rotation of the intermediate gears 3*b* and 3*b* are arranged on the straight line SL, the gears 3*a* and 3*b* are pressed in the direction of the straight line SL and receive an unstable load when the sizes of the gears 3*a* and 3*b* are increased to be greater than the desirable dimensions due to the manufacturing error or the rise in the temperature.

Such an unstable load, particularly, an unstable load acting on the driving gear 3*a* unstably moves each of the monochromatic toner image carriers 2 (Y, C, M) in the direction of the straight line SL, causing an uneven rotation or a color shift. As a result, obtained image quality is deteriorated.

In the conventional apparatus, with respect to the drive gear 3*a* (M) for driving the image carrier 2M, a driving force F sent from the intermediate gear 3*b* on the upstream side and a driving reaction force R sent from the intermediate gear 3*b* on the downstream side act.

On the other hand, since developing rollers 6 (Y, C, M) abut on the image carrier 2, an abutment force Fd acts on the image carrier 2.

In this configuration, since the driving force F, the driving reaction force R and the abutment force Fd sent from the developing roller (abutment member) 6 are sent in one direction (downward in FIG. 10B), a resultant force thereof acts as a great radial force on the bearing portion of the image carrier.

For this reason, the conventional apparatus has a problem in that a driving torque is increased and the bearing portion is apt to be deteriorated by a wear so that the rotation blurring of the image carrier is apt to be generated and image quality is thereby deteriorated easily.

Moreover, since the image carrier gear is provided on only one end of the image carrier, the great radial force acts on one end side thereof. The radial force on one end side (therefore, the imbalance of the radial force on both ends of the image carrier) causes the skew of the image carrier. When the image carrier skews, image forming conditions in an axial direction are changed. Therefore, there is a problem in that the image quality is deteriorated (the image quality in a transverse direction seen in the direction of delivery of the recording medium P is apparently varied).

The problems arise in a color image forming apparatus having one image carrier and a monochrome image forming apparatus as well as a tandem type image forming apparatus in which a plurality of image carriers are provided, and remarkably arise in a tandem type image forming apparatus in which a plurality of image carriers are provided.

As in the conventional apparatus, in the case in which the gear train 3 for driving a plurality of monochromatic toner image carriers 2 (Y, C, M) is constituted in a line, a color formed and transferred by the image carrier positioned in the final stage of the power transmission path causes a color shift or a jitter (a stripe-shaped density unevenness generated by a fluctuation in the speed of the image carrier) most easily by the accumulation of the manufacturing errors of the gears 3*a* (Y, C, M) and 3*b* constituting the gear train 3.

Moreover, in the case in which the gear train 3 is constituted in a line as shown in FIG. 10B, a driving force F sent from the intermediate gear 3*b* provided on the upstream side and a driving reaction force R sent from the intermediate gear 3*b* provided on the downstream side act on the driving gear (for example, 3*a*(M)) positioned on the way of the power transmission path, while only the driving force F sent from the intermediate gear 3*b* provided on the upstream side acts on the driving gear 3*a*(C) positioned in the final stage of the power transmission path. Therefore, the driving gears 3*a*(Y) and 3*a*(M) positioned on the way of the power transmission path and the driving gear 3*a*(C) positioned in the final stage are deformed differently.

For this reason, a color formed and transferred by the image carrier positioned in the final stage of the power transmission path causes the color shift or the jitter most easily.

Under such a situation, in the conventional apparatus, the driving gear 3*a*(C) of the image carrier 2(C) for cyan to be a relatively remarkable color is provided in the final stage of the power transmission path in the gear train 3. Therefore, the color shift and the jitter of the cyan image are easily remarkable in such a state that the toner images having a plurality of colors are superposed on the recording medium P. As a result, there is a problem in that the image quality of the whole color image is deteriorated.

As shown in FIG. 11, Japanese Patent Publication No. 11-231754A discloses a color image forming apparatus of such a type (an intermediate transfer type) comprising an intermediate transfer belt 6, and a plurality of monochromatic toner image carriers 2 (Y, M, C, K (black)) provided on the intermediate transfer belt 6, and serving to sequentially transfer toner images having different colors which are carried by the monochromatic toner image carriers to the intermediate transfer belt 6, so that the toner images are superposed thereon to form a color image. The color image is collectively transferred from the intermediate transfer belt 6 to a recording medium P at a secondary transfer portion T2.

In the color image forming apparatus using an electrophotographic technique, generally, there is sometimes caused such a phenomenon that a toner slightly sticks to a portion to which the toner should not originally stick (a so-called fog phenomenon).

In such a situation, in a structure in which an image carrier 2K for a black toner image which is the most remarkable is provided as a monochromatic toner image carrier for finally transferring a toner image to the intermediate transfer belt 6 to be the intermediate transfer member as in the apparatus of an intermediate transfer member type shown in FIG. 11, for example, a black toner TK is also transferred onto the recording medium P continuously together with the yellow toner TY as shown in FIG. 12A when the fog phenomenon is generated so that the black toner TK sticks onto the yellow toner TY in a portion in which the yellow image is to be originally formed and is then transferred collectively to the recording medium P in the secondary transfer portion T2 as shown in FIG. 12B, for example. As a result, there is such a drawback that the black color is remarkable in a color image on the recording medium P.

SUMMARY OF THE INVENTION

It is the first object of the invention to provide a color image forming apparatus capable of decreasing the unstable load to reduce the unstable movement of each monochromatic toner image carrier and of reducing an uneven rotation and a color shift, thereby enhancing the image quality.

It is the second object of the invention to provide a color image forming apparatus capable of reducing a driving torque, causing a bearing portion to be deteriorated by a wear with difficulty, and enhancing image quality.

It is the third object of the invention to provide a color image forming apparatus capable of reducing a color shift or a jitter, thereby enhancing image quality.

It is the fourth object of the invention to provide a color image forming apparatus capable of causing a color shift or a jitter to be unremarkable, thereby enhancing image quality.

In order to achieve the above objects, according to the present invention, there is provided a color image forming apparatus, comprising:

a circulating belt member, a plurality of monochrome toner image carriers, respectively opposing to the belt member to transfer each monochrome toner image onto the belt member or a recording medium held on the belt member;

a plurality of driving gears, each rotating one of the monochrome toner image carriers; and a plurality of intermediate gears, each disposed between adjacent driving gears, wherein a rotation center of each intermediate gear is placed at a position shifted from a line connecting rotation centers of the adjacent driving gears.

In this configuration, even if at least one of the sizes of the driving gear and the intermediate gear is increased to be greater than the desirable dimensions due to the manufacturing error or the swelling caused by the rise in the temperature in the apparatus, the driving gear is not directly pressed in the direction of the line connecting the rotation centers thereof.

Accordingly, an unstable load in the linear direction which acts on the driving gear is decreased so that the unstable movement of each monochromatic toner image carrier is also reduced.

As a result, according to the color image forming apparatus in accordance with the first aspect of the invention, the uneven rotation and color shift of the monochromatic toner image carrier can be reduced so that the image quality can be enhanced.

Preferably, each intermediate gear is movable in a direction perpendicular to the line connecting the rotation centers of the adjacent driving gears, when the intermediate gear is engaged with the adjacent driving gears.

In this configuration, even if at least one of the sizes of the driving gear and the intermediate gear is increased to be greater than the desirable dimension due to the manufacturing error or the swelling caused by the rise in the temperature in the apparatus, the intermediate gear is moved away in the direction orthogonal to the line connecting the rotation centers of the driving gears provided on both sides thereof in engagement with the driving gears.

Accordingly, the unstable load in the linear direction which acts on the driving gear is decreased still more and the unstable movement of each monochromatic toner image carrier is also reduced still more. As a result, the uneven rotation and color shift of each monochromatic toner image carrier can be reduced still more so that image quality can be enhanced still more.

Here, it is preferable that the apparatus further comprises a plurality of elastic members, each urging one of the intermediate gears in the direction perpendicular to the line connecting the rotation centers of the adjacent driving gears.

In this configuration, the engagement of the intermediate gear with the driving gear and the movement of the intermediate gear in the direction orthogonal to the line connecting the rotation centers of the driving gears can smoothly be carried out.

Alternatively, it is preferable that the apparatus further comprises a plurality of shafts, each inserted through a center hole formed in each intermediate gear for rotatably supporting the intermediate gear. Here, a clearance is formed between an outer face of the shaft and an inner face of the center hole.

In this configuration, the intermediate gear can be moved corresponding to the clearance without depending on the urging force of the elastic member in the direction orthogonal to the line connecting the rotation centers of the driving gears.

Preferably, the apparatus further comprises a common frame which supports the monochrome toner image carriers and the driving gears as a unit.

In this configuration, the monochromatic toner image carriers can be collectively attached to and removed from an apparatus body so that a maintenance property can be enhanced.

Furthermore, since a space between the rotation centers of the driving gears can be reduced, it is possible to reduce the size of the unit. As a result, the size of the whole apparatus can be reduced.

Here, it is preferable that the common frame supports the intermediate gears.

In this configuration, the state of reliable and smooth engagement of each driving gear and the intermediate gear can be maintained and the smooth and reliable rotation of each of the monochromatic toner image carriers can be ensured.

Preferably, a monochrome toner image carrier for transferring a least remarkable color toner image is driven by a drive gear placed at a final stage of a gear train including the drive gears and the intermediate gears.

Here, it is preferable that a monochrome toner image carrier for transferring a most remarkable color image is driven by a drive gear placed at an initial stage of a gear train including the drive gears and the intermediate gears.

Still here, it is preferable that the least remarkable color is yellow and the most remarkable color is black.

In the above configurations, even if a color shift or a jitter is occurred on a color formed and transferred by the monochromatic toner image carrier to be driven by the driving gear positioned in the final stage of the power transmission path, the shift or jitter of the image having the color becomes unremarkable in such a state that the toner images having a plurality of colors are formed on the recording medium. As a result, the resultant image quality of the whole color image can be enhanced.

Furthermore, if a fog phenomenon is occurred so that the yellow toner sticks onto the black toner in a portion in which a black image is to be originally formed, for example. Then, when the toner image is collectively transferred onto the recording medium in the secondary transfer portion, the yellow toner is covered with the black toner which is more remarkable (a toner which is more remarkable than the yellow toner and has a deeper color, and is not restricted to the black toner) over the recording medium even if the yellow toner is also transferred onto the recording medium continuously together with the black toner. As a result, the yellow color becomes unremarkable in a color image formed on the recording medium.

Therefore, the image quality of the whole color image can be enhanced still more.

Preferably, the color image forming apparatus further comprises at least one abutment member which abuts against each monochrome toner image carrier. Here, a resultant force obtained from at least one abutment force from the abutment member to one associated monochrome tone image carrier is oriented substantially opposite to a power transmission force from one drive gear for rotating the one monochrome toner image carrier to one subsequent intermediate gear.

Preferably, the resultant force obtained from the at least one abutment force is oriented substantially opposite to a resultant force obtained from the power transmission force and a reaction force acting to the one intermediate gear from one subsequent drive gear.

In the above configuration, In the above configurations, a power transmission force sent from the intermediate gear to the driving gear and a force acting on the image carrier by the abutment member are at least partially canceled with each other. Accordingly, a radial force acting as a resultant force on the bearing portion of the image carrier is more reduced than that of the conventional apparatus.

Therefore, a driving torque is reduced, a bearing portion is also deteriorated by a wear with difficulty and the rotation blurring of the image carrier is generated with difficulty so that image quality is deteriorated with difficulty.

Moreover, since the imbalance state of the radial force on both ends of the image carrier is relieved, the skew of the image carrier is also reduced. As a result, the image quality can be enhanced.

Preferably, a drive gear for rotating a monochrome toner image carrier, placed at a final stage of a gear train including the drive gears and the intermediate gears, circulates the belt member.

In this configuration, a driving force sent from the intermediate gear provided on the upstream side and a driving reaction force sent from the driven member side on the downstream side act on the driving gear for the, monochromatic toner image carrier in the final stage.

Consequently, a degree of deforming the driving gear positioned in the final stage of the power transmission path can be prevented from being greatly different from a degree of deforming the driving gear positioned on the way of the power transmission path.

Accordingly, the rotating state of the monochromatic toner image carrier positioned in the final stage of the power transmission path is more stabilized than that in the conventional apparatus, and a color shift or a jitter is generated with difficulty on a toner image formed and transferred by the image carrier. As a result, the image quality of a whole color image can be enhanced.

According to the present invention, there is also provided a color image forming apparatus, comprising:

a circulating belt member;

a plurality of monochrome toner image carriers, respectively opposing to the belt member to transfer each monochrome toner image onto the belt member or a recording medium held on the belt member;

a plurality of driving gears, each rotating one of the monochrome toner image carriers; and a plurality of intermediate gears, each disposed between adjacent driving gears for transmitting a driving force from a previous driving gear to a subsequent driving gear, wherein a monochrome toner image carrier for transferring a least remarkable color toner image is placed at a final stage of the monochrome toner image carriers with regard to a circulating direction of the belt member.

According to the present invention, there is also provided a color image forming apparatus, comprising:

a circulating belt member, a plurality of monochrome toner image carriers, respectively opposing to the belt member to transfer each monochrome toner image onto the belt member or a recording medium held on the belt member;

a plurality of driving gears, each rotating one of the monochrome toner image carriers;

a plurality of intermediate gears, each disposed between adjacent driving gears for transmitting a driving force from a previous driving gear to a subsequent driving gear;

at least one abutment member which abuts against each monochrome toner image carrier, wherein a resultant force obtained from at least one abutment force from the abutment member to one associated monochrome tone image carrier is oriented substantially opposite to a power transmission force from one drive gear for rotating the one monochrome toner image carrier to one subsequent intermediate gear.

According to the present invention, there is also provided a color image forming apparatus, comprising:

a circulating belt member;

a plurality of monochrome toner image carriers, respectively opposing to the belt member to transfer each monochrome toner image onto the belt member or a recording medium held on the belt member;

a plurality of driving gears, each rotating one of the monochrome toner image carriers; and a plurality of intermediate gears, each disposed between adjacent driving gears for transmitting a driving force from a previous driving gear to a subsequent driving gear, wherein a drive gear for rotating a monochrome toner image carrier, placed at a final stage of a gear train including the drive gears and the intermediate gears, drives another driven member.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of the invention will be described below with reference to the accompanying drawings.

Figure 1:
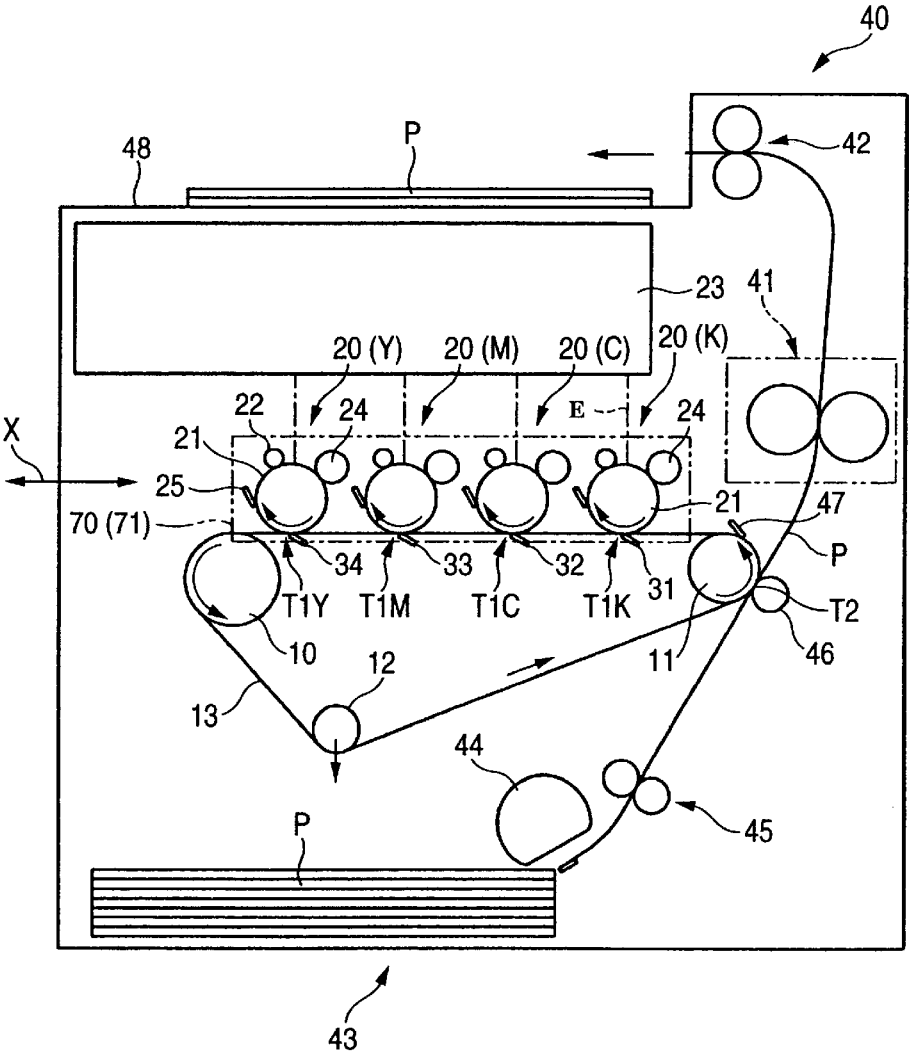
FIG. 1 is a schematic front view showing a color image forming apparatus according to a first embodiment of the invention.

As shown in FIG. 1, a color image forming apparatus according to a first embodiment comprises an intermediate transfer belt 13 provided over a driving roller 10, a driven roller 11 and a tension roller 12 and circulated in a direction of an arrow shown in the drawing (a counterclockwise direction), and a plurality of monochromatic toner image formers 20 (K, C, M, Y) provided with respect to the intermediate transfer belt 13, and toner images formed by the monochromatic toner image formers 20 are sequentially transferred through individual transferring members (transfer blades in this embodiment) 31, 32, 33 and 34 to the intermediate transfer belt 13. The respective transfer portions (primary transfer portions) are indicated as T1K, T1C, T1M and T1Y.

The monochromatic toner image formers 20(K) for black, 20(C) for cyan, 20(M) for magenta and 20(Y) for yellow are arranged. Each of these monochromatic toner image formers 20 (K, C, M, Y) include a toner image carrier (photosensitive member) 21 having a photosensitive layer on an outer peripheral surface to be a monochromatic toner image carrier, a charging roller 22 for uniformly charging the outer peripheral surface of the photosensitive member 21, an exposing unit 23 for selectively exposing the outer peripheral surface charged uniformly by the charging roller 22 and forming an electrostatic latent image thereon, a developing roller 24 for applying a toner serving as a developer to the electrostatic latent image formed by the exposing unit 23 to form a visible image (a toner image), and a cleaning blade 25 for removing a toner remaining on the surface of the photosensitive member 21 after the toner image developed by the developing roller 24 is transferred to the intermediate transfer belt 13.

The toner images which are sequentially transferred primarily to the intermediate transfer belt 13 and are sequentially superposed on the intermediate transfer belt 13 to have a full color are secondarily transferred to a recording medium P such as a paper in a secondary transfer portion T2, and pass through a fixing roller pair 41 to be a fixing portion and are thus fixed onto the recording medium P. The recording medium P is ejected onto a paper ejection tray 48 formed in the upper part of the case of an apparatus body 40 by a paper ejection roller pair 42.

The reference numeral 43 denotes a paper feeding cassette for stacking and storing a large number of recording media P. The reference numeral 44 denotes a pick-up roller for feeding the recording media P one by one from the paper feeding cassette 43. The reference numeral 45 denotes a gate roller pair for defining the supply timing of the recording media P to the secondary transfer portion T2. The reference numeral 46 denotes a secondary transfer roller for forming the secondary transfer portion T2 together with the intermediate transfer belt 13. The reference numeral 47 denotes a cleaning blade for removing the toner remaining on the surface of the intermediate transfer belt 13 after the secondary transfer.

Figure 2:
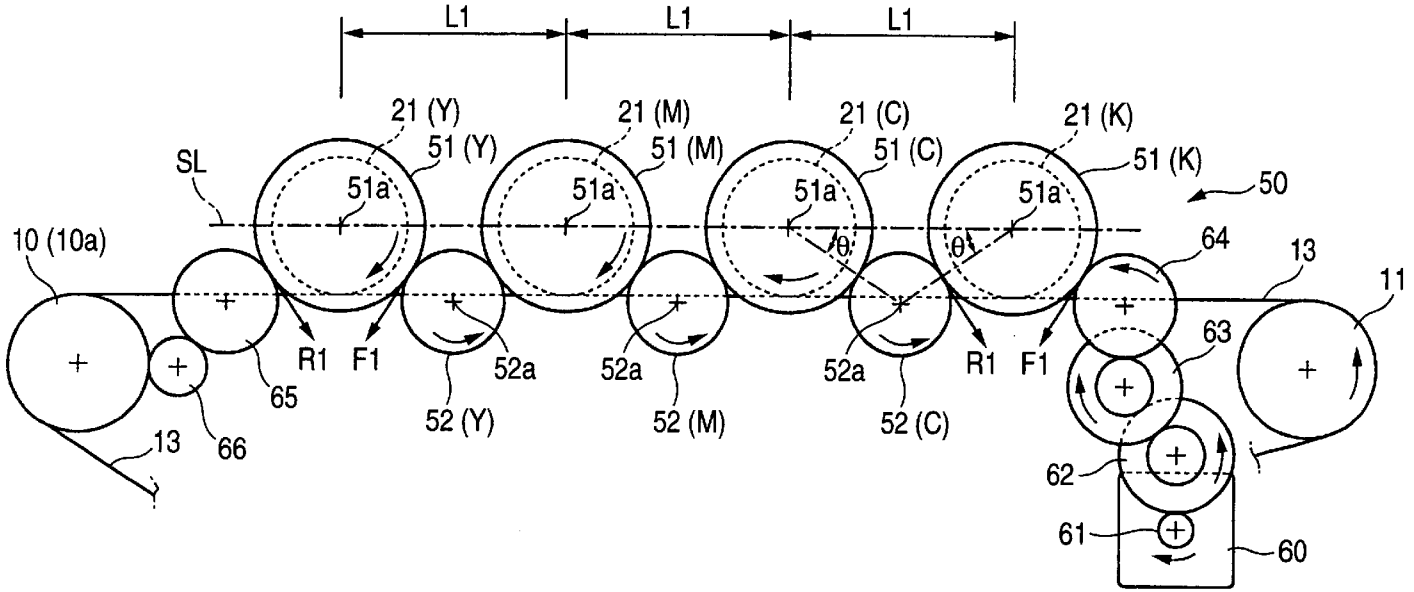
FIG. 2 is a schematic front view showing a driving system for monochromatic toner image carriers.

As shown in FIG. 2, the image forming apparatus has a driving gear train 50 for driving each of the monochromatic toner image carriers 21 (K, C, M, Y). The gear train 50 is driven by a motor 60 through a driving source gear 61, two reduction gears 62 and 63.

The gear train 50 includes driving gears 51 (K, C, M, Y) fixed to the ends of the monochromatic toner image carriers 21 (K, C, M, Y) (see FIG. 3) and serving to rotate the monochromatic toner image carriers 21, and intermediate gears 52 (C, M, Y) provided between the driving gears 51 (K, C, M, Y). The driving gears 51 (K, C, M, Y) and the intermediate gears 52 (C, M, Y) are provided in a line having no branch on a power transmission path (in a zigzag line).

More specifically, the driving source gear 61 is fixed to the output shaft of the motor 60 and is thus driven, and the image carrier 21K is rotated by the engagement of the driving gear 51K with the driving source gear 61 through the reduction gears 62 and 63, the image carrier 21C is rotated by the engagement of the driving gear 51C with the gear 51K through the intermediate gear 52C, the image carrier 21M is rotated by the engagement of the driving gear 51M with the gear 51C through the intermediate gear 52M, and the image carrier 21Y is rotated by the engagement of the driving gear 51Y with the gear 51M through the intermediate gear 52Y.

As shown in FIG. 2, rotation centers 52*a* of the intermediate gears 52 are provided in a position other than a line SL connecting the rotation centers of the driving gears 51 (a position shifted from the line SL).

The line SL is extended in the direction of the array of the monochromatic toner image carriers 21 (K, C, M, Y) and is basically parallel with a line connecting the primary transfer portions T1K, T1C, T1M and T1Y.

Accordingly, even if at least one of the sizes of the driving gear 51 and the intermediate gear 52 is increased to be greater than desirable dimensions due to the manufacturing error or the swelling caused by the rise in the temperature in the apparatus, the driving gear 51 is not directly pressed in the direction of the line SL connecting the rotation centers 51*a* thereof (but is pressed by a cosine component (see cosθ in FIG. 2).

Hence, an unstable load in the direction of the line SL which acts on the driving gear 51 is decreased to the degree represented by the cosine component so that the unstable movement of each monochromatic toner image carrier 21 is also reduced.

As a result, the uneven rotation and color shift of the monochromatic toner image carrier 21 can be reduced so that the image quality can be enhanced.

Figure 3:
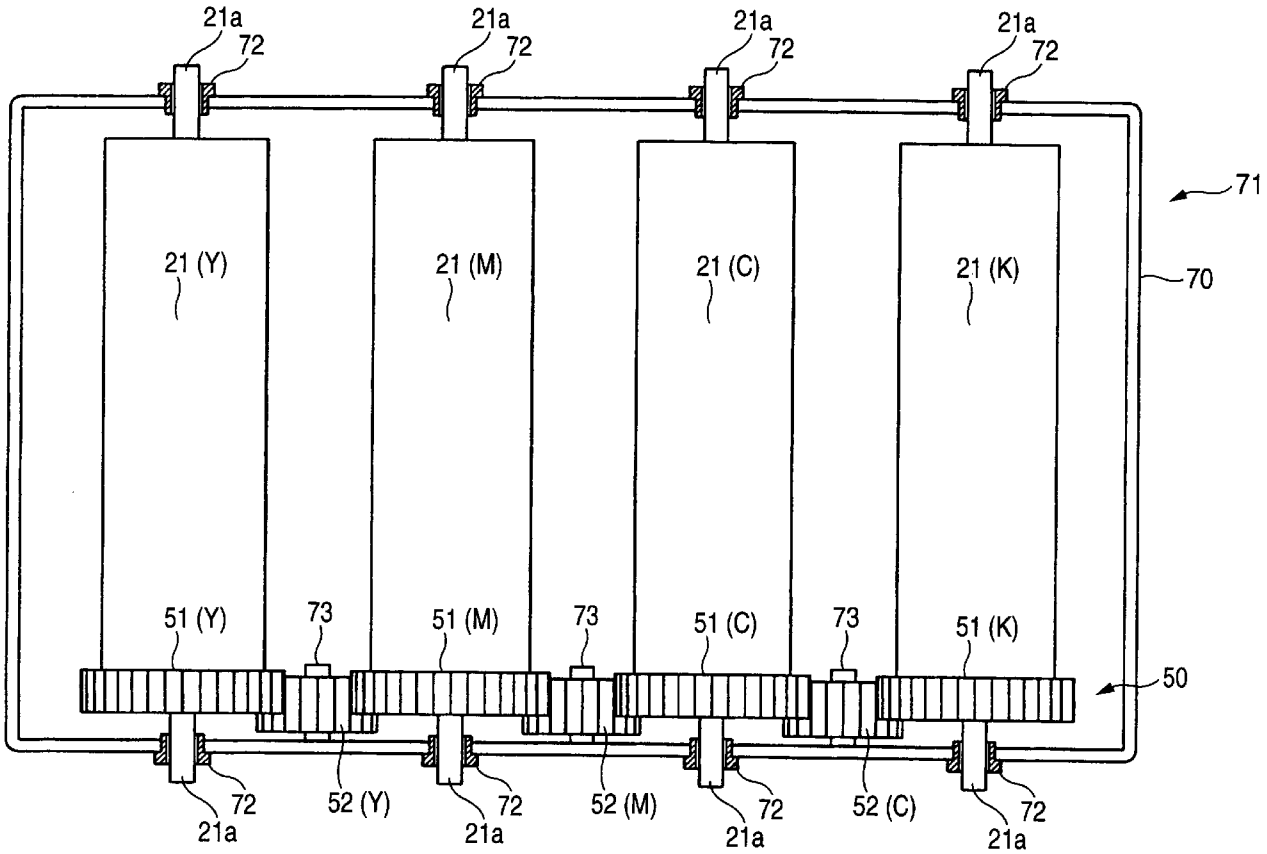
FIG. 3 is a partial sectional plan view showing a driving system unit.

As shown in FIG. 3, the monochromatic toner image carriers 21 (K, C, M, Y), the driving gears 51 (K, C, M, Y) and the intermediate gears 52 (C, M, Y) are supported on a common frame 70 and are constituted as a unit 71. The intermediate gears 52 (C, M, Y) may be supported on a frame (not shown) on the apparatus body side in place of the frame 70 of the unit 71.

In FIG. 3, the reference numeral 72 denotes a bearing for rotatably supporting a shaft 21*a* of the image carrier 21 and the reference numeral 73 denotes a shaft for rotatably supporting the intermediate gear 52.

Figure 4:
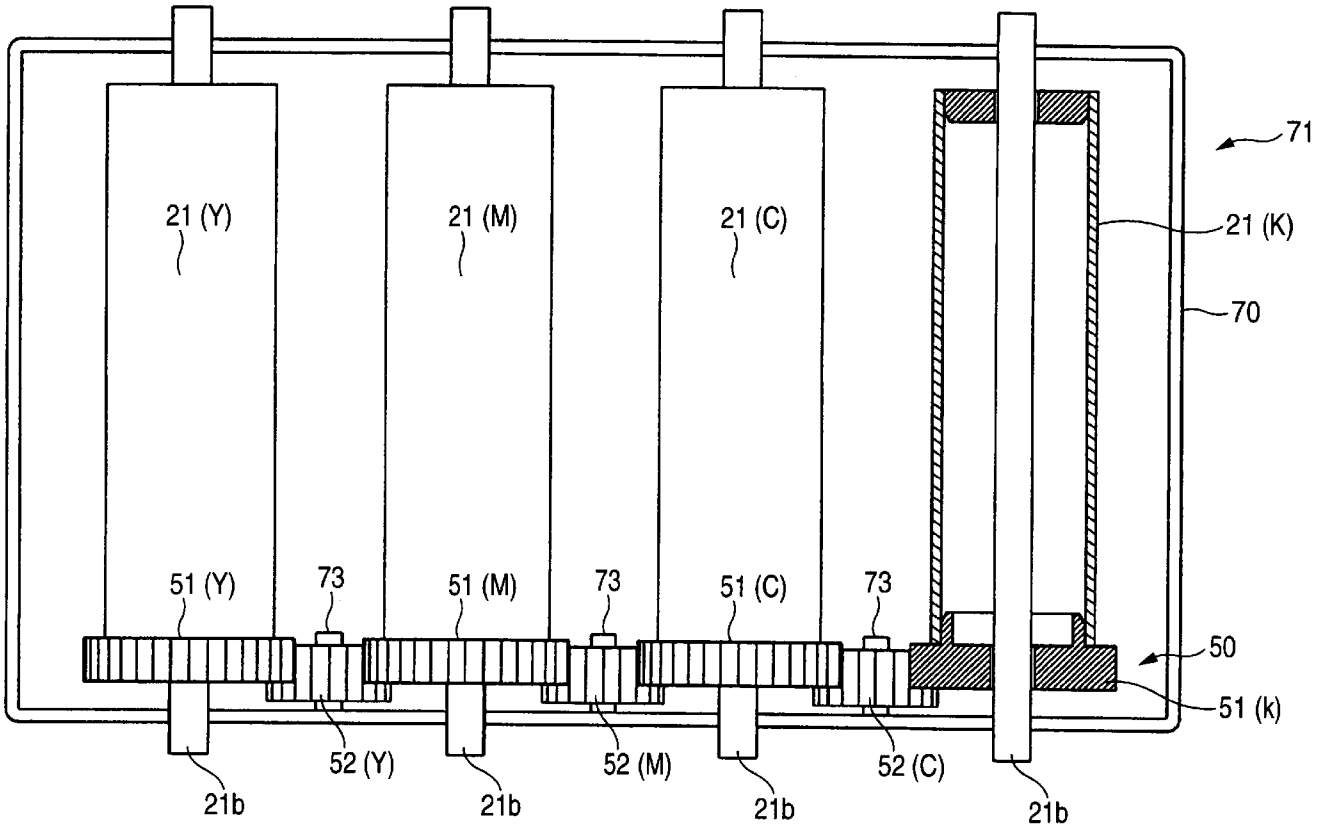
FIG. 4 is a partial sectional plan view showing a modified example of the driving system unit shown in FIG. 3.

As shown in FIG. 4, the image carrier 21 may be rotatably supported on a shaft 21*b* fixed to the frame 70.

According to the above configurations, the monochromatic toner image carriers 21 can be collectively attached to and removed from the apparatus body as shown in an arrow X in FIG. 1, for example, and a maintenance property can be enhanced.

Figure 10A:
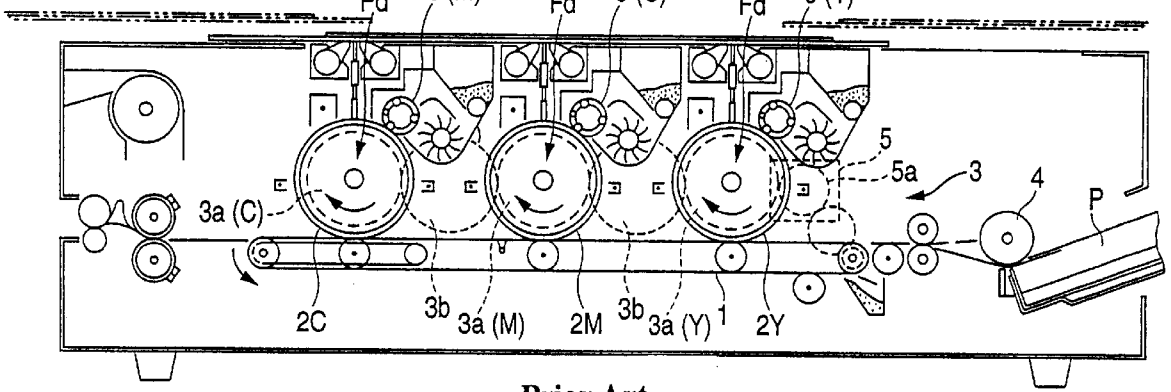
Prior Art FIG. 10A
FIGS. 10A and 10B are views showing a first conventional color image forming apparatus.
Figure 10B:
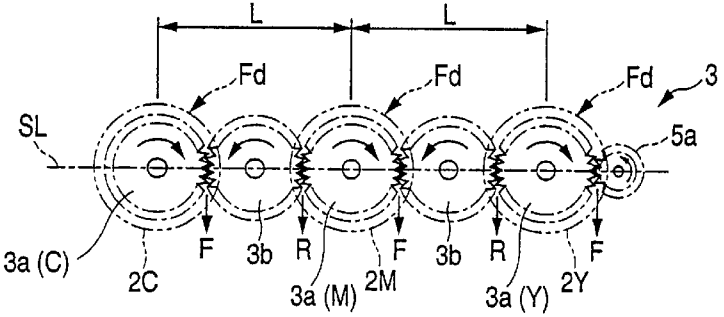
Prior Art FIG. 10B
Figure 11:
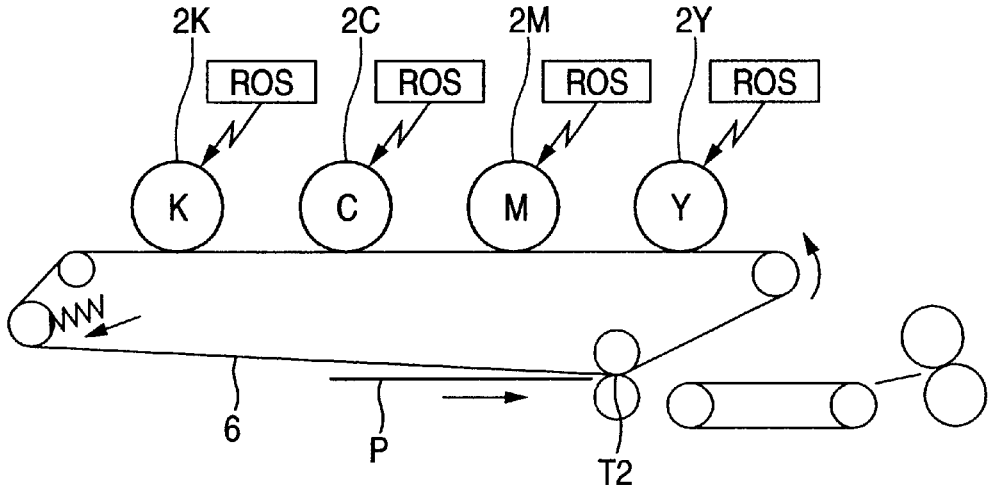
FIG. 11 is a front view showing a second conventional color image forming apparatus.
Figure 12A:
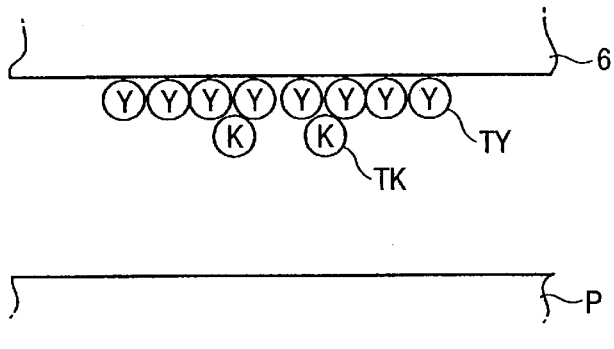
FIGS. 12A and 12B are conceptual views for explaining a fog phenomenon occurred in the second conventional color image forming apparatus.
Figure 12B:
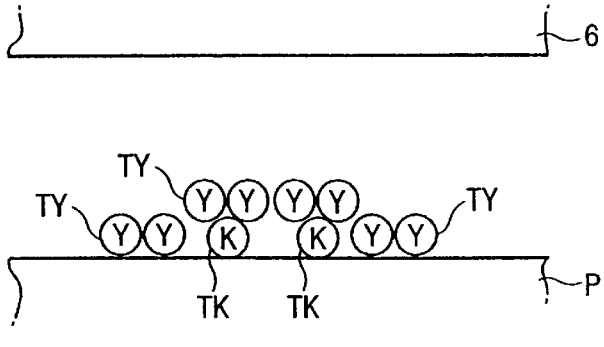
Prior Art FIG. 12B

By the way, it is necessary to increase the pitch diameter of the intermediate gear 52 to some extent in order to reliably and smoothly engage with the driving gears 51 provided on both sides thereof (to increase the number of teeth such that the engagement can be carried out reliably and smoothly). As shown in FIG. 10B, for example, when the rotation center of the driving gear (3*a*) and that of the rotation of the intermediate gear (3*b*) in the gear train 3 are provided on the straight line (SL), a space (L) between the rotation centers of the driving gears is also increased when the pitch circular diameter of the intermediate gear is increased.

For this reason, in the case in which the rotation center of the driving gear (3*a*) and that of the rotation of the intermediate gear (3*b*) in the gear train are provided on the straight line (SL) and the gears are to be constituted as a unit as shown in FIG. 10B, for example, the width of the unit is increased in the direction of the space (L).

In the case in which the rotation center of the driving gear (3*a*) and that of the rotation of the intermediate gear (3*b*) in the gear train are provided on the straight line (SL) as shown in FIG. 10B, it is very hard to provide the intermediate gear (3*b*) on the apparatus body side without incorporation into the unit. The reason is that it is very hard to engage the driving gear (3*a*) on the unit side with the intermediate gear (3*b*) on the apparatus body side during the attachment and removal of the unit if the intermediate gear (3*b*) is provided on the apparatus body side. For this reason, in the case in which the rotation center of the driving gear (3*a*) and that of the rotation of the intermediate gear (3*b*) in the gear train are provided on the straight line (SL) as shown in FIG. 10B, the intermediate gear (3*b*) is to be also incorporated in the unit if a plurality of monochromatic toner image carriers and driving gears thereof are to be constituted as a unit. As a result, there is also such a drawback that the size of the unit is increased still more.

On the other hand, according to the color image forming apparatus in this embodiment, the rotation center 52*a* of the intermediate gear 52 in the gear train 50 is provided in a position other than the line SL connecting the rotation centers of the driving gears 51. Correspondingly, a space L1 between the centers 51*a* of the rotation of the driving gears 51 can be reduced (see FIG. 2).

According to the color image forming apparatus in accordance with the embodiment, therefore, it is possible to reduce the size of the unit 71. As a result, the size of the whole apparatus can be reduced.

Furthermore, since the intermediate gear 52 is also supported on the common frame 70 and is constituted as the unit 71, as compared with the case in which the intermediate gear 52 is provided on the apparatus body side, the state of reliable and smooth engagement of each driving gear 51 and the intermediate gear 52 can be maintained and the smooth and reliable rotation of each of the monochromatic toner image carriers 21 can be ensured.

Even if the intermediate gear 52 is incorporated in the unit 71, moreover, the center 52*a* of the rotation of the intermediate gear 52 in the gear train 50 is provided in the position other than the line SL connecting the rotation centers of the driving gears. Therefore, the size of the unit 71 can be reduced as described above.

In the gear train 50 described above, a driving gear 51 receives a driving force (a power transmission force) sent from an intermediate gear 52 on the upstream side and a reaction force sent from an intermediate gear 52 on the downstream side.

Figure 5:
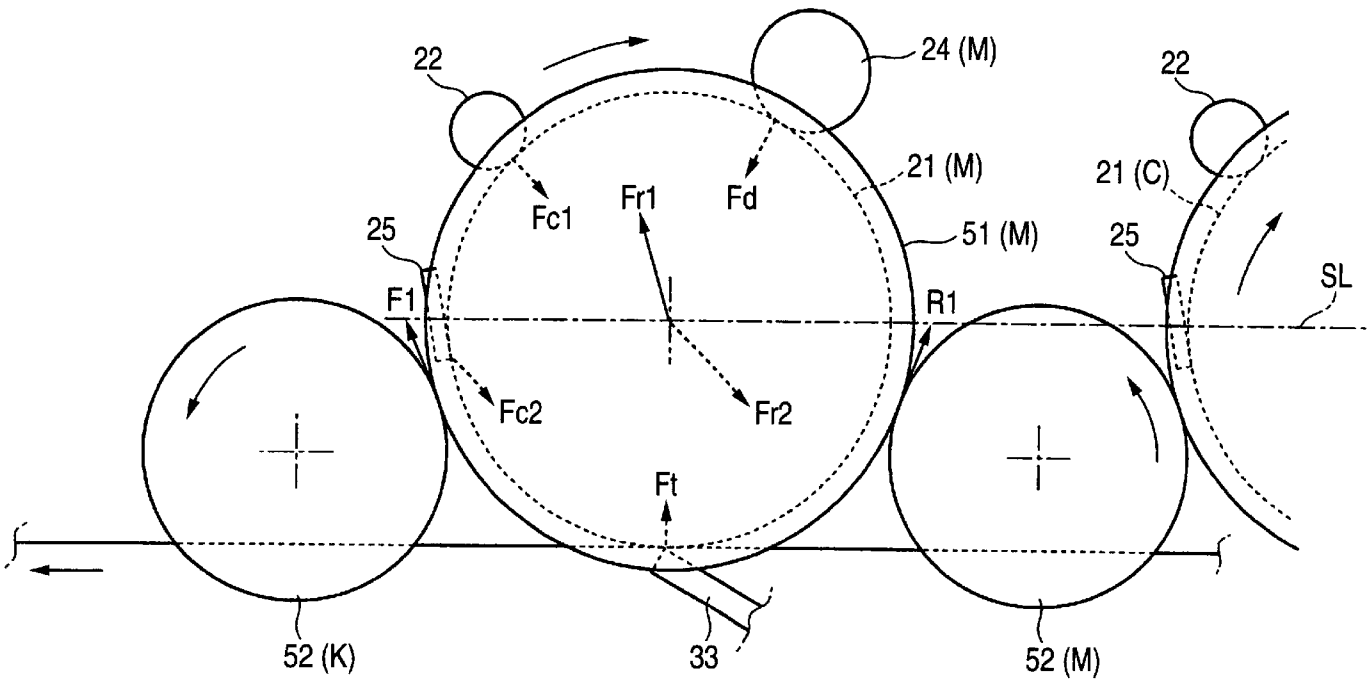
FIG. 5 is an enlarged view showing the driving system shown in FIG. 2.

FIG. 5 representatively shows the image carrier 21(M) for magenta and the driving gear 51(M) thereof, and the driving gear 51(M) receives a driving force (a power transmission force) F1 sent from the intermediate gear 52(K) on the upstream side and a reaction force (a driving reaction force) RI sent from the intermediate gear 52(M) on the downstream side. The resultant force of the driving force F1 and the driving reaction force R1 is indicated as Fr1.

On the other hand, the charging roller 22, the developing roller 24, the cleaning blade 25 and the transferring member 33 (which is indicated as 33 because the image carrier 21(M) for magenta is representatively shown in FIG. 5) which act as abutment members abut on the image carrier 21(M) as described above. Therefore, the image carrier 21 receives abutment forces Fc1, Fd, Fc2 and Ft from the abutment members. The resultant force of the abutment forces Fc1, Fd, Fc2 and Ft is indicated as Fr2.

In the embodiment, as shown in FIG. 5, the gear train 50 and the driving path thereof are constituted such that each of the direction of the driving force F1 and the direction of the resultant force Fr1 (an upward direction in FIG. 5) is substantially opposite to the direction of the resultant force Fr2 (a downward direction in FIG. 5).

Since the direction F1 of power transmission from the intermediate gear 52 to the driving gear 51 is substantially opposite to the direction of the force Fr2 acting on the image carrier by the abutment member, the power transmission force F1 and the force Fr2 are at least partially canceled with each other.

In addition, since the direction of the force Fr1 is substantially opposite to the direction of the force Fr2 acting on the image carrier by the abutment member, the resultant force Fr1 and the resultant force Fr2 are at least partially canceled with each other.

Accordingly, the radial force to be the resultant force which acts on the bearing portion (e.g., 72 in FIG. 3) of the image carrier is more reduced than that in conventional apparatus.

Therefore, the driving torque is reduced, the bearing portion is deteriorated by a wear with difficulty, and the rotation blurring of the image carrier 21 is generated with difficulty, so that image quality is deteriorated with difficulty.

Moreover, since the imbalance state of the radial force on both ends of the image carrier 21 is relieved, the skew of the image carrier 21 is also reduced. As a result, the image quality can be enhanced.

In this embodiment, as shown in FIG. 2, the driving gear 51(Y) for the monochromatic toner image carrier 21(Y) in the final stage in the power transmission system path formed by the gear train 50 is constituted to drive the driving roller 10 of the intermediate transfer belt 13 through an intermediate gear 65 and an idle gear 66. A gear 10*a* is fixed to the end of the driving roller 10 and the idle gear 66 is engaged with the gear 10*a*.

In the embodiment, all the pitch circular diameters of the intermediate gear 64, the intermediate gear 52 and the intermediate gear 65 which are engaged with each other on the upstream and downstream sides of the driving gear 51 are identical to each other.

Accordingly, a driving force F1 sent from the intermediate gear 52(Y) provided on the upstream side and a driving reaction force R1 sent from the driven member side on the downstream side (in this case, an intermediate gear 65) act on the driving gear 51(Y) for the monochromatic toner image carrier 21(Y) in the final stage.

Consequently, a degree of deforming the driving gear 51(Y) positioned in the final stage of the power transmission path can be prevented from being greatly different from a degree of deforming the driving gears 51 (K, C, M) positioned on the way of the power transmission path.

Hence, the rotating state of the monochromatic toner image carrier 21(Y) positioned in the final stage of the driving path is more stabilized than that in the conventional apparatus, and a color shift or a jitter is generated with difficulty on a toner image formed and transferred by the image carrier 21(Y). As a result, the image quality of a whole color image can be enhanced.

As is apparent from the foregoing and FIGS. 1 and 3, the driving gear 51(Y) of the monochromatic toner image carrier 21(Y) for an yellow toner image having the most unremarkable (lightest) color is provided as a driving gear in a final stage in a power transmission path formed by the gear train 50. The monochromatic toner image carrier 21(Y) for the yellow toner image is provided as a monochromatic toner image carrier for finally transferring the toner image to the intermediate transfer belt 13.

The easiness of the remarkability of the four colors is in order of black (K), cyan (C) or magenta (M), and yellow (Y).

In this configuration, even if a color shift or a jitter is generated on an yellow color formed and transferred by the monochromatic toner image carrier 21(Y) to be driven by the driving gear 51(Y) positioned in the final stage of the power transmission path, the shift or jitter of the image having the yellow color becomes unremarkable in such a state that the toner images having a plurality of colors (K, C, M, Y) are formed on the recording medium P. As a result, the image quality of the whole color image can be enhanced.

In the embodiment, the driving gear 51K and the image carrier 21K for the black having the most remarkable color are provided on the initial stage of the power transmission path which causes a color shift with the most difficulty. Therefore, the image quality of the whole color image can be enhanced still more.

Figure 6A:
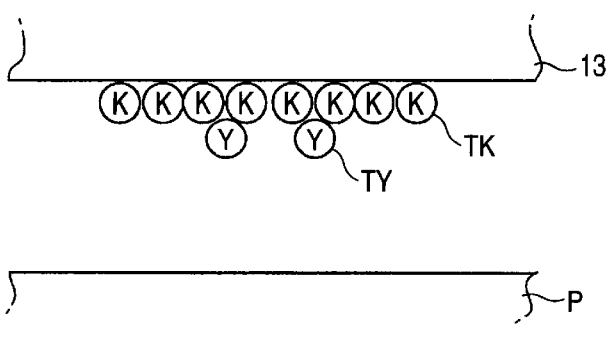
FIGS. 6A and 6B are conceptual views for explaining a fog phenomenon occurred in the color image forming apparatus of the invention.
Figure 6B:
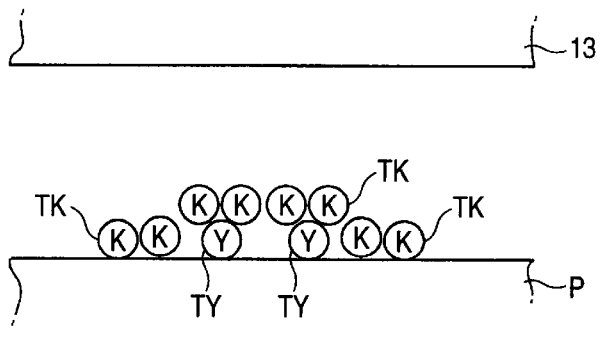

Furthermore, a fog phenomenon is occurred so that the yellow toner TY sticks onto the black toner TK in a portion in which a black image is to be originally formed as shown in FIG. 6A, for example. Then, when the toner image is collectively transferred onto the recording medium P in the secondary transfer portion T2, the yellow toner TY is covered with the black toner which is more remarkable (a toner which is more remarkable than the yellow toner and has a deeper color, and is not restricted to the black toner but may be a cyan toner or a magenta toner) over the recording member P even if the yellow toner TY is also transferred onto the recording medium P continuously together with the black toner TK as shown in FIG. 6B. As a result, the yellow color becomes unremarkable in a color image formed on the recording medium P.

According to the color image forming apparatus, therefore, the image quality of the whole color image can be enhanced still more.

As is also apparent from FIG. 1, the secondary transfer portion T2 for transferring a color toner image from the intermediate transfer belt 13 to the recording medium P is formed in the winding portion of the intermediate transfer belt 13 on the driven roller 11, and the recording medium P serves to pass through the secondary transfer portion T2 upward.

Moreover, the cleaning blade 47 for removing the toner remaining on the intermediate transfer belt 13 after the secondary transfer abuts on the intermediate transfer belt 13 in the winding portion of the intermediate transfer belt 13 on the driven roller 11.

Figure 7:
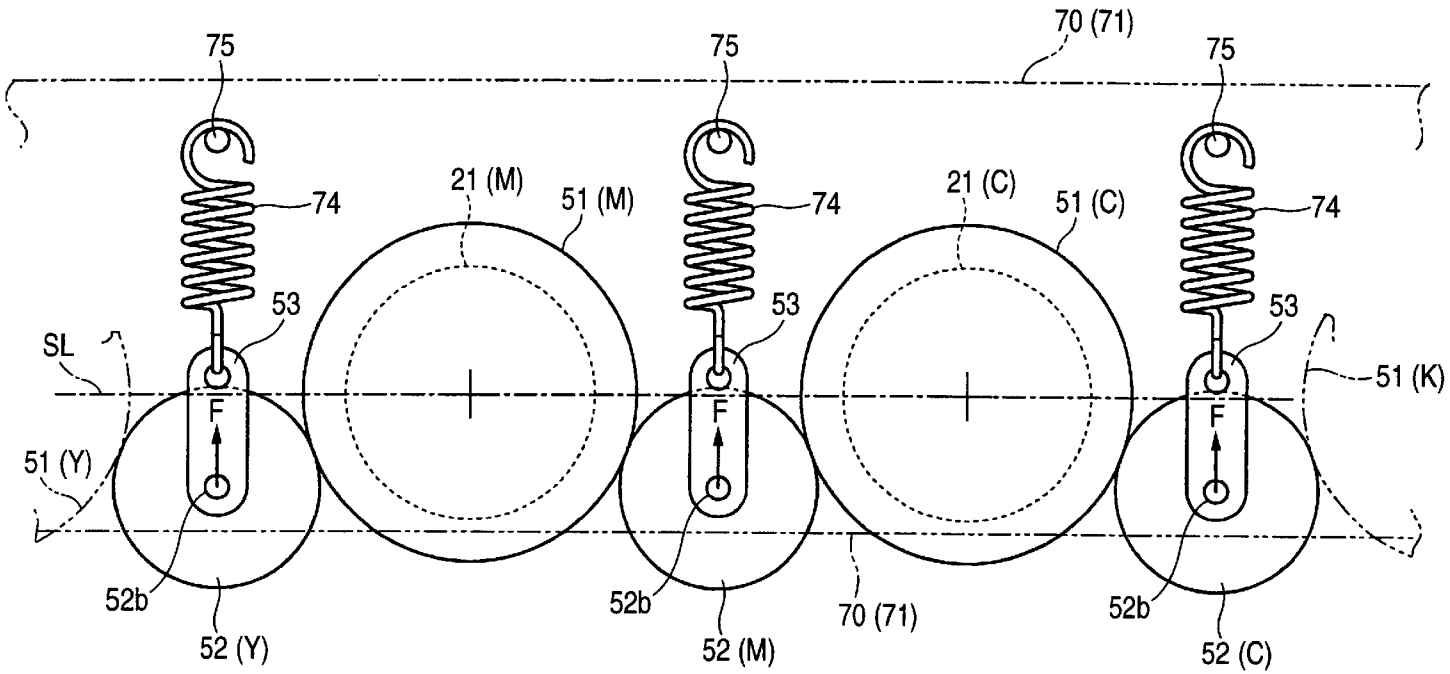
FIG. 7 is a partial schematic front view showing an essential part of a driving system in color image forming apparatus according to a second embodiment of the color image forming apparatus of the invention.

FIG. 7 is a partial schematic front view showing the essential part of the driving system for monochromatic toner image carriers in a color image forming apparatus according to a second embodiment of the invention. In this figure, portions which are the same as or correspond to the portions in the first embodiment have the same reference numerals.

The embodiment is the same as the first embodiment except that an intermediate gear 52 is constituted movably in a direction orthogonal to a line SL connecting the rotation centers of driving gears 51 (in a vertical direction of FIG. 7), when it is meshed with the driving gears 51.

The intermediate gear 52 according to the embodiment is urged by an elastic member (in this case, a tension spring) 74 toward the line SL.

The reference numeral 53 denotes a support member for supporting a shaft end 52*b* of the intermediate gear 52, and the tension spring 74 is extended between the support member 53 and a hooking portion 75 provided on a frame 70. Consequently, the intermediate gear 52 is urged toward the line SL.

According to the embodiment, in addition to advantageous effects attained by the first embodiment, the following advantageous effects can be obtained.

Even if at least one of the sizes of the driving gear 51 and the intermediate gear 52 is increased to be greater than desirable dimensions due to a manufacturing error thereof or swelling caused by a rise in a temperature in the apparatus, the intermediate gear 52 is moved away in the direction orthogonal to the line SL in engagement with the driving gears 51.

Accordingly, an unstable load in the direction of the line SL which acts on the driving gear 51 is decreased still more, and the unstable movement of each monochromatic toner image carrier 21 is also reduced still more. As a result, the uneven rotation and color shift of the monochromatic toner image carrier 21 can be reduced still more so that image quality can be enhanced still more.

Since the intermediate gear 52 is urged by the elastic member 74 toward the line SL, the engagement of the intermediate gear 52 with the driving gear 51 and the movement of the intermediate gear 52 in the direction orthogonal to the line SL can be carried out smoothly.

Figure 8A:
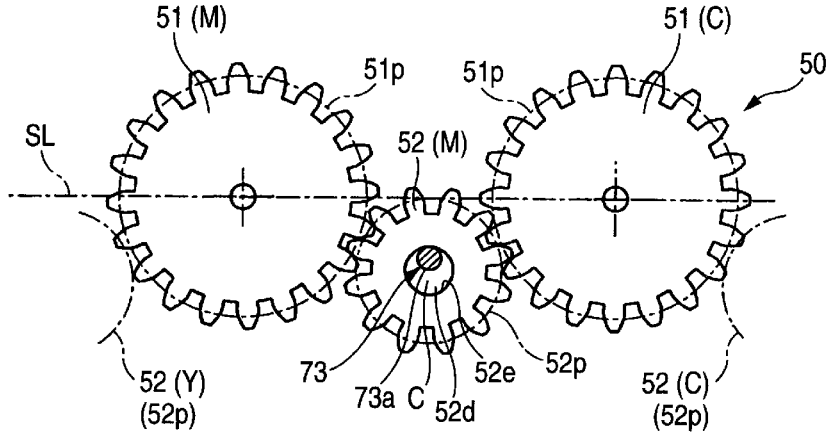
FIGS. 8A and 8B are partial schematic front views showing an essential part of a driving system in color image forming apparatus according to a third embodiment of the color image forming apparatus of the invention.
Figure 8B:
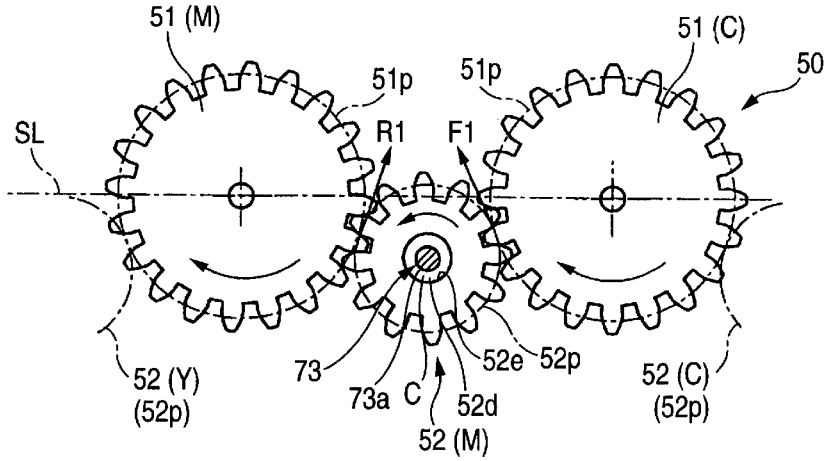

FIGS. 8A and 8B are partial schematic front view showing the essential part of the driving system for monochromatic toner image carriers in a color image forming apparatus according to a third embodiment of the invention. In this figure, portions which are the same as or correspond to the portions in the first embodiment have the same reference numerals. An intermediate gear 52(M) and driving gears 51(C) and 51(M) provided on both sides thereof are representatively shown.

The embodiment is the same as the first embodiment except that the intermediate gear 52 is constituted movably in a direction orthogonal to a line SL connecting the rotation centers of the driving gears 51 (in a vertical direction of these figures) in engagement with the driving gears 51.

The intermediate gear 52 according to the embodiment is rotatably supported by the insertion of a shaft 73 in a hole 52*d* provided on a center thereof, and a clearance C is formed between an inner peripheral face 52*e* of the hole 52*d* and an outer peripheral face 73*a*of the shaft 73, and is thereby constituted movably in the direction orthogonal to the line SL (in the vertical direction of these figures).

As shown in FIG. 8A, in the case in which the operation of the apparatus is stopped so that a power is not transmitted by the gear train 50, the intermediate gear 52 is maintained to be moved downward by a self-weight such that the inner peripheral face 52*e* of the hole 52*d* abuts on the shaft 73 and a pitch circle 52*p* is slightly separated from a pitch circle 51*p* of the driving gear 51 (such that the teeth of the intermediate gear 52 and the driving gear 51 can be prevented from being disengaged from each other).

On the other hand, as shown in FIG. 8B, when the apparatus is operated so that the power is transmitted by the gear train 50, the intermediate gear 52 (in this case, 52(M)) is moved in the direction of the engagement of both driving gears 51(C) and 51(M) (in a direction toward the line SL, that is, upward in the drawing) upon receipt of a driving force Fl sent from the driving gear 51 (in this case, 51(C)) on the upstream side of a power transmission system and a driving reaction force R1 sent from the driving gear 51 (in this case, 51(M)) on the downstream side, and is reliably engaged with both of the driving gears 51(C) and 51(M) to transmit a power. In this state, a clearance C is formed like an almost ring between the inner peripheral face 52*e* of the hole 52*d* of the intermediate gear 52 and the outer peripheral face 73*a* of the shaft 73.

When the operation of the apparatus is stopped so that the power is not transmitted by the driving gear train 50, the state shown in FIG. 8A is returned.

According to the embodiment, in addition to advantageous effects attained by the first embodiment, the following advantageous effects can be obtained.

Even if at least one of the sizes of the driving gear 51 and the intermediate gear 52 is increased to be greater than desirable dimensions due to the manufacturing error thereof or the swelling caused by a rise in a temperature in the apparatus, the intermediate gear 52 is moved away without depending on the urging force of the elastic member as in the second embodiment.

Accordingly, an unstable load in the direction of the line SL which acts on the driving gear 51 is decreased still more and the unstable movement of each monochromatic toner image carrier 21 is also reduced still more. As a result, the uneven rotation and color shift of the monochromatic toner image carrier 21 can be reduced still more so that image quality can be enhanced still more.

More specifically, in the embodiment, the intermediate gear 52 is rotatably supported by the insertion of the shaft 73 in the hole 52*d* provided on a center thereof, and the clearance C is formed between the inner peripheral face 52*e* of the hole 52*d* and the outer peripheral face 73*a*of the shaft 73. Corresponding to the clearance C, therefore, the intermediate gear 52 is movable without receiving the urging force of the elastic member in the direction orthogonal to the line SL connecting the rotation centers of both of the driving gears 51, and an unstable load in the direction of the line SL which acts on the driving gear 51 is remarkably decreased and the unstable movement of the monochromatic toner image carrier 21 is also reduced considerably. As a result, the uneven rotation and color shift of the monochromatic toner image carrier can be reduced still more so that image quality can be enhanced still more.

Differently from the second embodiment, the urging member is not required. Therefore, the number of components can be reduced and a structure can also be simplified.

Figure 9:
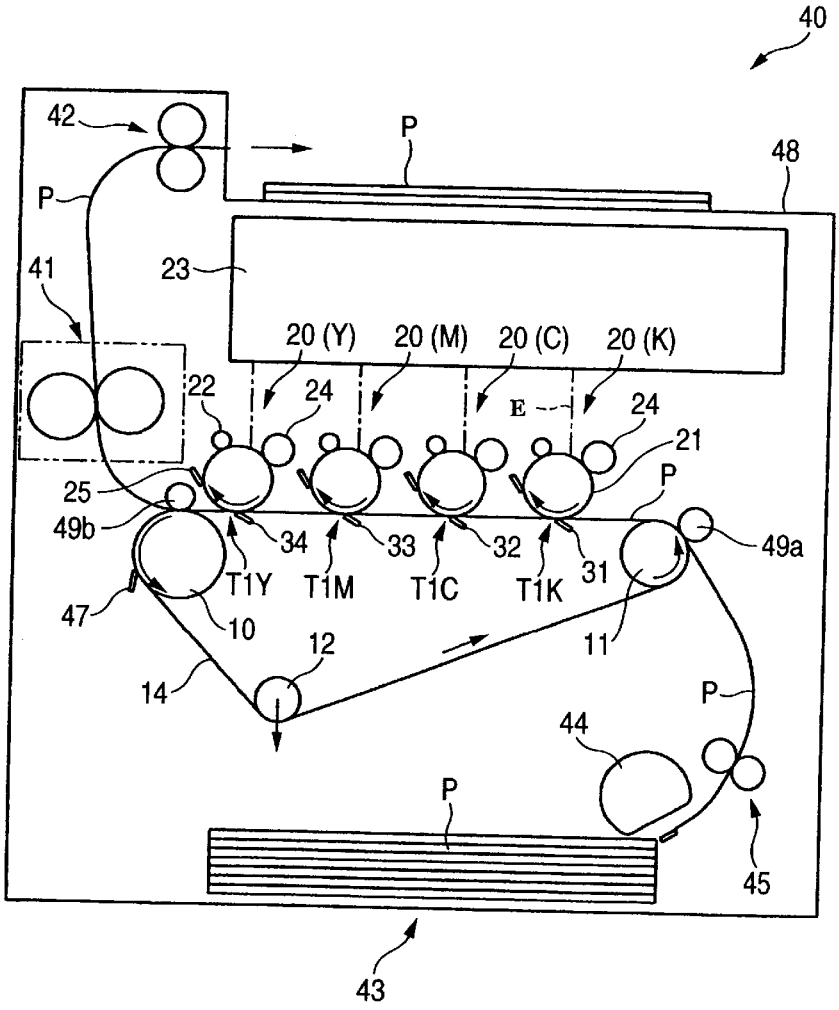
FIG. 9 is a schematic front view showing a color image forming apparatus according to a fourth embodiment of the invention.

FIG. 9 is a schematic front view showing a color image forming apparatus according to a fourth embodiment of the invention. In this figure, portions which are the same as or correspond to the portions in the first to third embodiments have the same reference numerals.

The embodiment is the same as the first to third embodiments except that a recording medium delivery belt 14 for holding and delivering a recording medium P is used in place of the intermediate transfer belt 13 and toner images formed by a plurality of monochromatic toner image former 20 (K, C, M, Y) are sequentially transferred through individual transferring members 31 to 34 to the recording medium P held in the recording medium delivery belt 14.

In FIG. 9, the reference numeral 49*a* denotes a recording medium adsorbing roller for holding the recording medium P from a gate roller pair 45 by the recording medium delivery belt 14, and the reference numeral 49*b* denotes a separating roller for peeling the recording medium P from the recording medium delivery belt 14 and for supplying the recording medium P to a fixing roller pair 41.

Also in such an embodiment, the same advantageous effects as those in the first to third embodiments can be obtained. A difference is that the toner images formed by the monochromatic toner image former 20 (K, C, M, Y) are sequentially transferred through the individual transferring members 31 to 34 to the recording medium P held by the recording medium delivery belt 14.

While the embodiment of the invention has been described above, the invention is not restricted to the embodiment but can be properly changed without departing from the scope of the invention.

What is claimed is:

1. A color image forming apparatus, comprising:

a circulating belt member;

a plurality of monochrome toner image carriers, respectively opposing to the belt member to transfer each monochrome toner image onto the belt member or a recording medium held on the belt member;

a plurality of driving gears, each rotating one of the monochrome toner image carriers; and a plurality of intermediate gears, each disposed between adjacent driving gears for transmitting a driving force from a previous driving gear to a subsequent driving gear, wherein a rotation center of each intermediate gear is placed at a position shifted from a line connecting rotation centers of the adjacent driving gears; and wherein each intermediate gear is movable in a direction perpendicular to the line connecting the rotation centers of the adjacent driving gears, when the intermediate gear is engaged with the adjacent driving gears.

2. The color image forming apparatus as set forth in claim 1, further comprising a plurality of elastic members, each urging one of the intermediate gears in the direction perpendicular to the line connecting the rotation centers of the adjacent driving gears.

3. The color image forming apparatus as set forth in claim 1, further comprising a plurality of shafts, each inserted through a center hole formed in each intermediate gear for rotatably supporting the intermediate gear, wherein a clearance is formed between an outer face of the shaft and an inner face of the center hole.

4. The color image forming apparatus as set forth in claim 1, further comprising a common frame which supports the monochrome toner image carriers and the driving gears as a unit.

5. The color image forming apparatus as set forth in claim 4, wherein the common frame supports the intermediate gears.

6. The color image forming apparatus as set forth in claim 1, wherein a monochrome toner image carrier for transferring a least remarkable color toner image is driven by a drive gear placed at a final stage of a gear train including the drive gears and the intermediate gears.

7. The color image forming apparatus as set forth in claim 6, wherein a monochrome toner image carrier for transferring a most remarkable color image is driven by a drive gear placed at an initial stage of a gear train including the drive gears and the intermediate gears.

8. The color image forming apparatus as set forth in claim 7, wherein the most remarkable color is black.

9. The color image forming apparatus as set forth in claim 6, wherein the least remarkable color is yellow.

10. The color image forming apparatus as set forth in claim 1, further comprising at east one abutment member which abuts against each monochrome toner image carrier, wherein a resultant force obtained from at least one abutment force from the abutment ember to one associated monochrome tone image carrier is oriented substantially opposite to a transmission force from one drive gear for rotating the one monochrome toner image carrier to one subsequent intermediate gear.

11. The color image forming apparatus as set forth in claim 10, wherein the resultant force obtained from the at least one abutment force is oriented substantially opposite to a resultant force obtained from the power transmission force and a reaction force acting to the one intermediate gear from one subsequent drive gear.

12. The color image forming apparatus as set forth in claim 1, wherein a drive gear for rotating a monochrome toner image carrier, placed at a final stage of a gear train including the drive gears and the intermediate gears, circulates the belt member.

13. A color image forming apparatus, comprising:

a circulating belt member;

a plurality of monochrome toner image carriers, respectively opposing to the belt member to transfer each monochrome toner image onto the belt member or a recording medium held on the belt member;

a plurality of driving gears, each rotating one of the monochrome toner image carriers; and a plurality of intermediate gears, each disposed between adjacent driving gears for transmitting a driving force from a previous driving gear to a subsequent driving gear, wherein a monochrome toner image carrier for transferring a least remarkable color toner image is driven by a drive gear placed at a final stage of a gear train including the drive gears and the intermediate and wherein a monochrome toner image carrier for transferring a black color image is driven by a drive gear placed at an initial stage of the gear train including the drive gears and the intermediate gears.

14. The color image forming apparatus as set forth in claim 13, wherein the least remarkable color is yellow.

15. The color image forming apparatus as set forth in claim 13, wherein a rotation center of each intermediate gear is placed at a position shifted from a line connecting rotation centers of the adjacent driving gears.

16. The color image forming apparatus as set forth in claim 15, wherein each intermediate gear is movable in a direction perpendicular to the line connecting the rotation centers of the adjacent driving gears, when the intermediate gear is engaged with the adjacent driving gears.

17. The color image forming apparatus as set forth in claim 16, further comprising a plurality of elastic members, each urging one of the intermediate gears in the direction perpendicular to the line connecting the rotation centers of the adjacent driving gears.

18. The color image forming apparatus as set forth in claim 16, further comprising a plurality of shafts, each inserted through a center hole formed in each intermediate gear for rotatably supporting the intermediate gear, wherein a clearance is formed between an outer face of the shaft and an inner face of the center hole.

19. The color image forming apparatus as set forth in claim 13, further comprising a common frame which supports the monochrome toner image carriers and the driving gears as a unit.

20. The color image forming apparatus as set forth in claim 19, wherein the common frame supports the intermediate gears.

21. The color image forming apparatus as set forth in claim 13, further comprising at least one abutment member which abuts against each monochrome toner image carrier, wherein a resultant force obtained from at least one abutment force from the abutment member to one associated monochrome tone image carrier is oriented substantially opposite to a power transmission force from one drive gear for rotating the one monochrome toner image carrier to one subsequent intermediate gear.

22. The color image forming apparatus as set forth in claim 21, wherein the resultant force obtained from the at least one abutment force is oriented substantially opposite to a resultant force obtained from the power transmission force and a reaction force acting to the one intermediate gear from one subsequent drive gear.

23. The color image forming apparatus as set forth in claim 13, wherein a drive gear for rotating a monochrome toner image carrier, placed at a final stage of a gear train including the drive gears and the intermediate gears, circulates the belt member.

24. A color image forming apparatus, comprising:

a circulating belt member;

a plurality of monochrome toner image carriers, respectively opposing to the belt member to transfer each monochrome toner image onto the belt member or a recording medium held on the belt member;

a plurality of driving gears, each rotating one of the monochrome toner image carriers;

a plurality of intermediate gears, each disposed between adjacent driving gears for transmitting a driving force from a previous driving gear to a subsequent driving gear;

at least one abutment member which abuts against each monochrome toner image carrier, wherein a resultant force obtained from at least one abutment force from the abutment member to one associated monochrome tone image carrier is oriented substantially opposite to a power transmission force from one drive gear for rotating the one monochrome toner image carrier to one subsequent intermediate gear; and wherein each intermediate gear is movable in a direction perpendicular to the line connecting rotation centers of the adjacent driving gears, when the intermediate gear is engaged with the adjacent driving gears.

25. The color image forming apparatus as set forth in claim 24, wherein the resultant force obtained from the at least one abutment force is oriented substantially opposite to a resultant force obtained from the power transmission force and a reaction force acting to the one intermediate gear from one subsequent drive gear.

26. The color image forming apparatus as set forth in claim 24, wherein a rotation center of each intermediate gear is placed at a position shifted from a line connecting the rotation centers of the adjacent driving gears.

27. The color image forming apparatus as set forth in claim 24, further comprising a plurality of elastic members, each urging one of the intermediate gears in the direction perpendicular to the line connecting the rotation centers of the adjacent driving gears.

28. The color image forming apparatus as set forth in claim 24, further comprising a plurality of shafts, each inserted through a center hole formed in each intermediate gear for rotatably supporting the intermediate gear, wherein a clearance is formed between an outer face of the shaft and an inner face of the center hole.

29. The color image forming apparatus as set forth in claim 24, further comprising a common frame which supports the monochrome toner image carriers and the driving gears as a unit.

30. The color image forming apparatus as set forth in claim 29, wherein the common frame supports the intermediate gears.

31. The color image forming apparatus as set forth in claim 24, wherein a monochrome toner image carrier for transferring a least remarkable color toner image is driven by a drive gear placed at a final stage of a gear train including the drive gears and the intermediate gears.

32. The color image forming apparatus as set forth in claim 31, wherein a monochrome toner image carrier for transferring a most remarkable color image is driven by a drive gear placed at an initial stage of a gear train including the drive gears and the intermediate gears.

33. The color image forming apparatus as set forth in claim 32, wherein the most remarkable color is black.

34. The color image forming apparatus as set forth in claim 31, wherein the least remarkable color is yellow.

35. The color image forming apparatus as set forth in claim 24, wherein a drive gear for rotating a monochrome toner image carrier, placed at a final stage of a gear train including the drive gears and the intermediate gears, circulates the belt member.

36. A color image forming apparatus, comprising:

a circulating belt member;

a plurality of monochrome toner image carriers, respectively opposing to the belt member to transfer each monochrome toner image onto the belt member or a recording medium held on the belt member;

a plurality of driving gears, each rotating one of the monochrome toner image carriers; and a plurality of intermediate gears, each disposed between adjacent driving gears for transmitting a driving force from a previous driving gear to a subsequent driving gear, wherein a drive gear for rotating a monochrome toner image carrier, placed at a final stage of a gear train including the drive gears and the intermediate gears, drives another driven member.

37. The color image forming apparatus as set forth in claim 36, wherein a rotation center of each intermediate gear is placed at a position shifted from a line connecting rotation centers of the adjacent driving gears.

38. The color image forming apparatus as set forth in claim 37, wherein each intermediate gear is movable in a direction perpendicular to the line connecting the rotation centers of the adjacent driving gears, when the intermediate gear is engaged with the adjacent driving gears.

39. The color image forming apparatus as set forth in claim 38, further comprising a plurality of elastic members, each urging one of the intermediate gears in the direction perpendicular to the line connecting the rotation centers of the adjacent driving gears.

40. The color image forming apparatus as set forth in claim 38, further comprising a plurality of shafts, each inserted through a center hole formed in each intermediate gear for rotatably supporting the intermediate gear, wherein a clearance is formed between an outer face of the shaft and an inner face of the center hole.

41. The color image forming apparatus as set forth in claim 36, further comprising a common frame which supports the monochrome toner image carriers and the driving gears as a unit.

42. The color image forming apparatus as set forth in claim 41, wherein the common frame supports the intermediate gears.

43. The color image forming apparatus as set forth in claim 36, wherein a monochrome toner image carrier for transferring a least remarkable color toner image is driven by a drive gear placed at a final stage of a gear train including the drive gears and the intermediate gears.

44. The color image forming apparatus as set forth in claim 43, wherein a monochrome toner image carrier for transferring a most remarkable color image is driven by a drive gear placed at an initial stage of a gear train including the drive gears and the intermediate gears.

45. The color image forming apparatus as set forth in claims 44, wherein the most remarkable color is black.

46. The color image forming apparatus as set forth in claim 43, the least remarkable color is yellow.

47. The color image forming apparatus as set forth in claim 36, further comprising at least one abutment member which abuts against each monochrome toner image carrier, wherein a resultant force obtained from at least one abutment force from the abutment member to one associated monochrome tone image carrier is oriented substantially opposite to a power transmission force from one drive gear for rotating the one monochrome toner image carrier to one subsequent intermediate gear.

48. The color image forming apparatus as set forth in claim 47, wherein the resultant force obtained from the at least one abutment force is oriented substantially opposite to a resultant force obtained from the power transmission force and a reaction force acting to the one intermediate gear from one subsequent drive gear.

49. The color image forming apparatus as set forth in claim wherein the another driven member is the belt member.

50. A color image forming apparatus, comprising:

a circulating belt member;

a plurality of monochrome toner image carriers, respectively opposing to the belt member to transfer each monochrome toner image onto the belt member or a recording medium held on the belt member;

a plurality of driving gears, each rotating one of the monochrome toner image carriers; and a plurality of intermediate gears, each disposed between adjacent driving gears for transmitting a driving force from a previous driving gear to a subsequent driving gear, wherein a rotation center of each intermediate gear is placed at a position shifted from a line connecting rotation centers of the adjacent driving gears; and a plurality of shafts, each inserted through a center hole formed in each intermediate gear for rotatably supporting the intermediate gear, wherein a clearance is formed between an outer face of the shaft and an inner face of the center hole.

* * * * *

UNITED STATES PATENT AND TRADEMARK OFFICE

CERTIFICATE OF CORRECTION

PATENT NO. : 6,708,013 B2
DATED : March 16, 2004
INVENTOR(S) : Yujiro Nomura

It is certified that error appears in the above-identified patent and that said Letters Patent is hereby corrected as shown below:

Title page,
Insert Item:
-- [30] Foreign Application Priority Data
June 14, 2001 (JP)…….. P2001-179793 --

Signed and Sealed this

Seventh Day of September, 2004

JON W. DUDAS
*Director of the United States Patent and Trademark Office*